US006269962B1

(12) United States Patent
Anderson et al.

(10) Patent No.: US 6,269,962 B1
(45) Date of Patent: Aug. 7, 2001

(54) ENHANCED STRENGTH CONTAINER

(75) Inventors: Jeffrey Blake Anderson, Newmarket; Donna Lee Terry, Scarborough; Ross Bradsen, Toronto, all of (CA)

(73) Assignee: Colgate-Palmolive Company, New York, NY (US)

( * ) Notice: Subject to any disclaimer, the term of this patent is extended or adjusted under 35 U.S.C. 154(b) by 0 days.

(21) Appl. No.: 09/488,859

(22) Filed: Jan. 21, 2000

(51) Int. Cl.[7] ..... B65D 23/10

(52) U.S. Cl. ..... 215/398; 215/383; 220/608; 220/675

(58) Field of Search ..... 215/398, 383, 215/396, 400; 220/608, 675, 669, 672, DIG. 12, DIG. 13

(56) References Cited

U.S. PATENT DOCUMENTS 4,846,359 * 7/1989 Baird et al. ..... 215/12.2
4,865,211 * 9/1989 Hollingsworth .
4,971,211 * 11/1990 Lake ..... 215/6
5,383,558 * 1/1995 Wilkinson et al. ..... 215/398
5,615,790 * 4/1997 Young et al. ..... 215/375
5,711,445 * 1/1998 Robbins, III ..... 220/8
5,924,588 * 7/1999 Brennan .
5,968,618 * 10/1999 Miller .
6,068,901 * 5/2000 Medal ..... 428/35.7
6,076,699 * 6/2000 Seager et al. ..... 220/710.5

* cited by examiner

*Primary Examiner*—Stephen Castellano
(74) *Attorney, Agent, or Firm*—Michael J. McGreal

(57) ABSTRACT

The container of this invention has an increased strength in compression. When filled and with a closure the containers can withstand greater compressive force without a resulting deflection. This permits the use of a lighter weight and less costly shipper carton. The containers have a substantially rigid base, and except for rigidifying recesses, a substantially planar base. Further, the sidewalls of the container are substantially devoid of recesses and projections, and particularly, in the region of the base of the container. In addition, the sidewalls have a slight outward taper from an area at an upper part of the sidewall to the base of the container.

14 Claims, 3 Drawing Sheets

ENHANCED STRENGTH CONTAINER

FIELD OF THE INVENTION

This invention relates to containers that have an enhanced strength and which when filled and sealed can withstand an increased top load. More particularly this invention relates to cylindrical-like containers that have a sidewall that is substantially devoid of recesses and projections

BACKGROUND OF THE INVENTION

In designing containers for liquid products one objective is to have the filled and closed containers carry the weight of like containers stacked above these containers. The containers will be in cartons or on shrink wrapped platforms. The contact will be carton to carton or platform to closure for shrink wrapped units. Since the filled containers will bear a substantial part of the weight of stacked units, there is a continuing effort to produce containers that have improved strength. The containers require a high burst strength and a high compression strength. Also, the container should not permanently deform from the effect of the compressive load. The result is that the container units can be stacked higher and in the instance where corrugated cartons are used, the cartons can be of a lighter weight. This is the case since a part of the load carried by the carton can be transferred to the containers.

BRIEF SUMMARY OF THE INVENTION

The present invention is directed to containers which can carry greater compressive loads without being deformed. The containers are cylindrical-like containers. Cylindrical-like containers are those that are cylindrical with a set radius, multisided containers which are substantially cylindrical, and oval shapes that are substantially cylindrical shaped containers. The containers have a continuous sidewall, a base closing a first end of the sidewall, and an opening of a second end of the sidewall. The opening can be directly at the second end of the sidewall or it can be at the end of a section extending from the second end of the sidewall. In many instances such extending sections will be substantially conical in shape. Further, the containers have a substantially rigid base surface.

The containers in a preferred embodiment are cylindrical-like and have a sidewall, a base closing a first end of the sidewall and an opening at a second end of the sidewall. The sidewall is devoid of any one of a recess and a projection at a lower part of the sidewall to thereby increase the compressive strength of the container when the container is substantially filled with a liquid. In a further preferred embodiment the full sidewall is devoid of any one of a recess or a projection. In a yet further preferred embodiment the container sidewall has an outward taper from an upper part of the sidewall to a lower part of the sidewall. In still a further preferred embodiment, the container will have a conical-like extension extending upwardly from the second end of the sidewall to an opening.

The result of the container design is a container that has a higher compression strength when substantially filled. The force to a given deflection of the bottle is increased in this bottle design. This increased strength allows for greater stacking of the containers, and cartons of containers. And, if the stacking height is maintained, the amount of corrugate in the packing carton can be decreased. This is the case since some of the compression strength provided by the carton is not needed. A reduction in the amount of corrugate used results in an overall cost savings.

BRIEF DESCRIPTION OF THE INVENTION

DETAILED DESCRIPTION OF THE INVENTION

The present invention is directed to a container that has increased strength in compression. Containers are in compression when they are stacked on a pallet or on a shelf. When stacked on a pallet they can be in corrugated cartons or on a corrugated tray and then shrink wrapped with a plastic sheet material. When put on shelves the cartons are opened at the top and/or side and stacked one on the other, and if shrink wrapped, the shrink wrap is removed and the containers on the trays are stacked one on another.

There is a distinct advantage to have containers that have an increased strength in compression. In some instances pallets or containers can be stacked higher. In other instances the pallet height can remain the same with the corrugate weight of the carton decreased. That is, the contribution of the carton to the compression strength can be decreased. This is accomplished by removing carton weight. This, in turn, reduces the carton cost.

Figure 1:
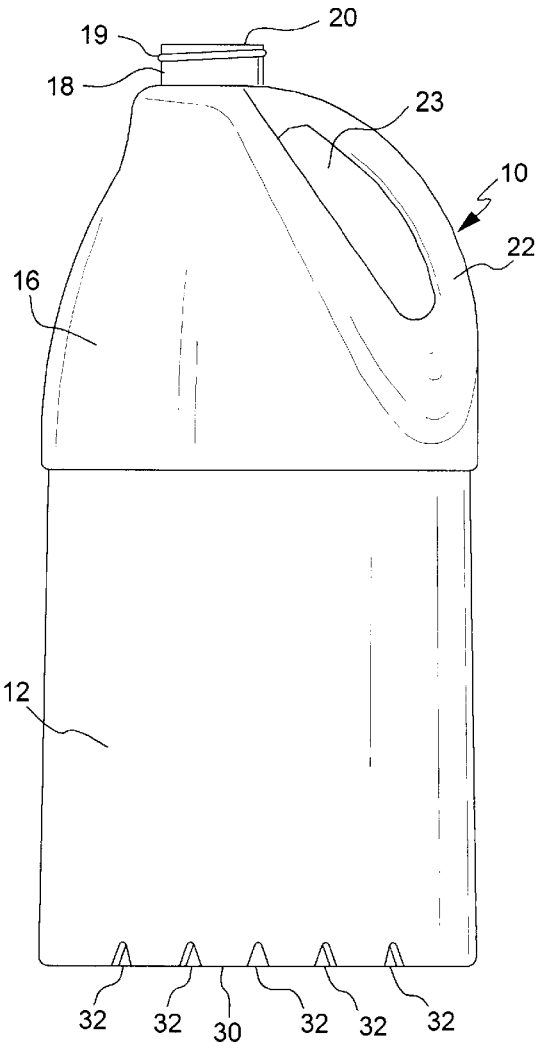
FIG. 1 is an elevational view of a container having a sidewall and base surface that has an increased compression strength.
Figure 2:
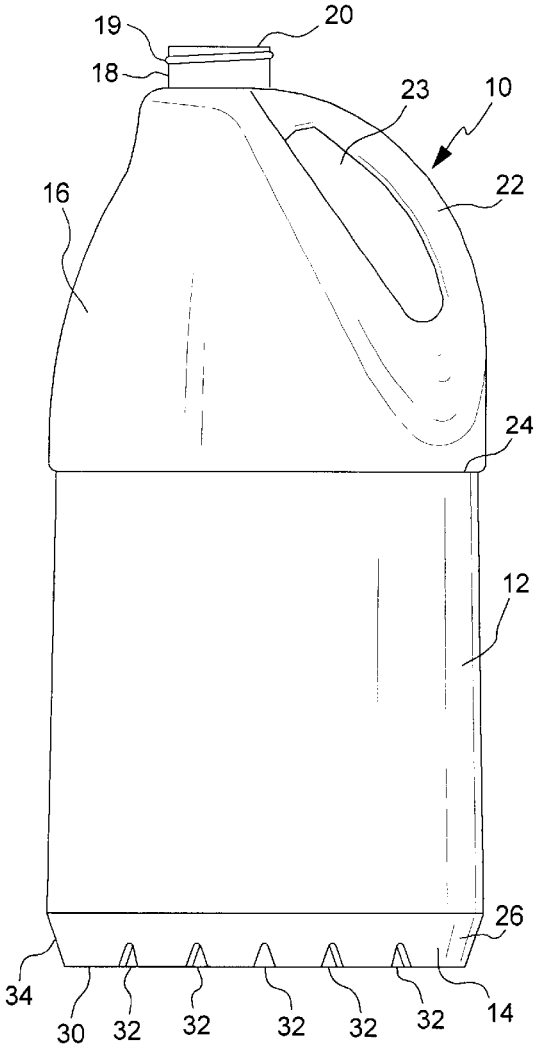
FIG. 2 is an elevational view of an alternate embodiment of the container of FIG. 1.
Figure 3:
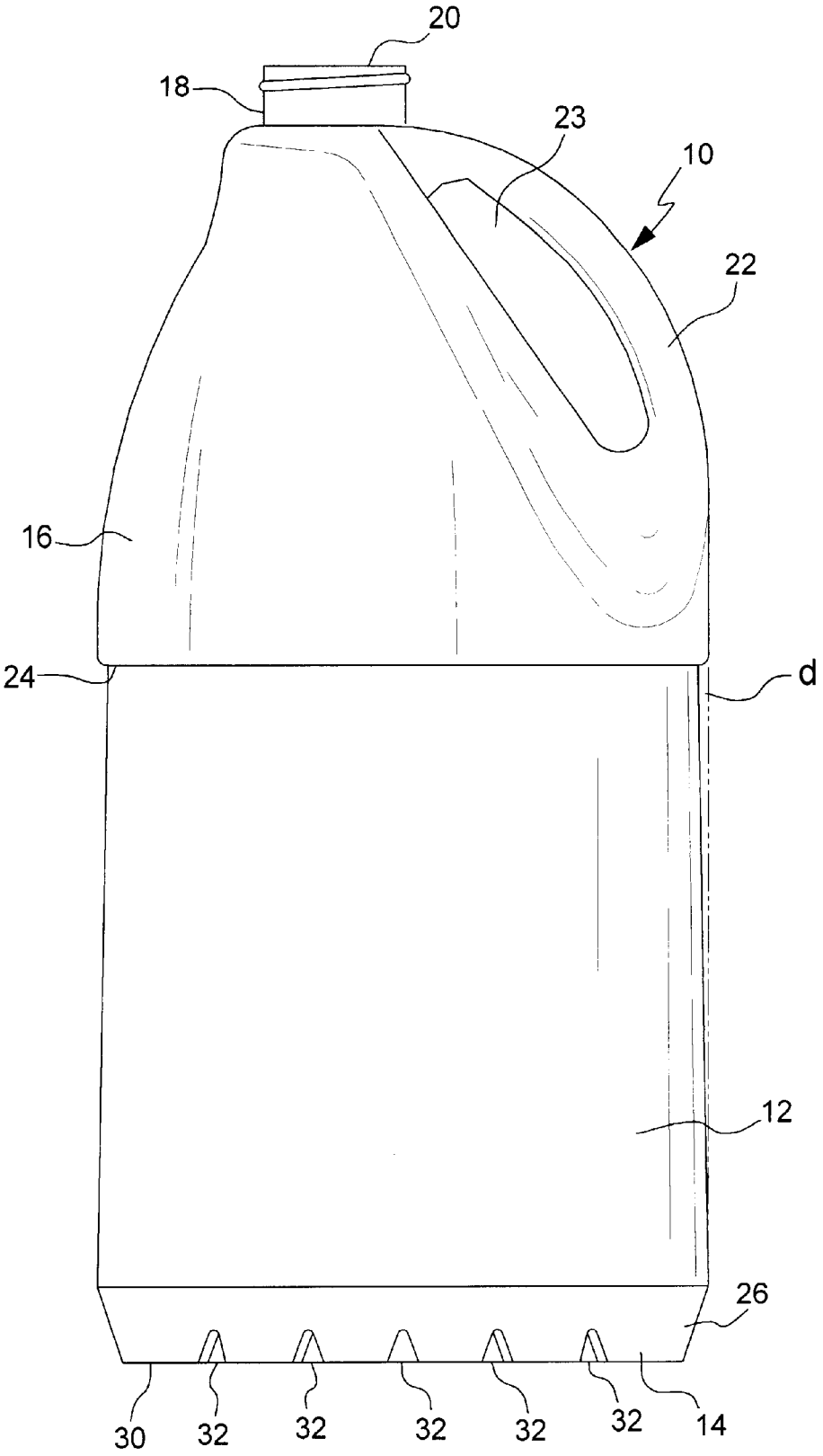
FIG. 3 is an elevational view of the container of FIG. 2 showing a taper to the sidewall.

The bottles shown in FIGS. 1 through 3 embody the present invention. These bottles have an increased strength in compression. The bottles 10 are comprised of a substantially cylindrical sidewall 12 which has a base 14, an upper extending section 16 which has a handle 22 with aperture 23 for several fingers to pass through. At the upper end of the extending section is mouth cylinder 18 with threads 19 and opening 20. The base 14 has a surface 30 with reinforcing recesses 32. These recesses rigidify the base of the container. The container has a ridge 24 at the junction of extending section 16 and the sidewall 12. This ridge serves to form a label area on the upper part of the sidewall. The sidewall has a outward taper "d" from the upper part of the sidewall to the lower part of the sidewall as shown in FIG. 3. The taper is an outward taper at an angle of about 1° to about 5°.

In FIG. 2 the base is shown with bevel 26 with bevel wall 34. As in FIGS. 1 and 3 the base has a lower surface 30 and a plurality of recesses 32. The base is substantially rigid and will maintain its shape upon the application of a compressive load up to sidewall deflection. The base is substantially flat with recesses 32 extending across the surface of the base. These recesses serve to rigidify the base. These recesses can vary in number, size and shape. The objective is to form a rigid base to assist in preventing bottle deflection. The base surface is substantially planar except for the recesses 32. In this way it forms a platform with a large surface area for contact with the supporting surface. The objective is to maximize this surface area while maximizing the rigidity of the base surface.

One key feature is the sidewall 12 being devoid of any projection or recess in the sidewall 12 of the container 10, and particularly in the lower part of sidewall 12 near the base 14. In this regard there cannot be any projecting ridge or recess partially or fully encircling the sidewall section 12 adjacent the base of the sidewall. Further the lower part of sidewall preferably has a cross-section dimension equivalent to a greater than the cross-section dimension of any other part of the container.

Figure 4:
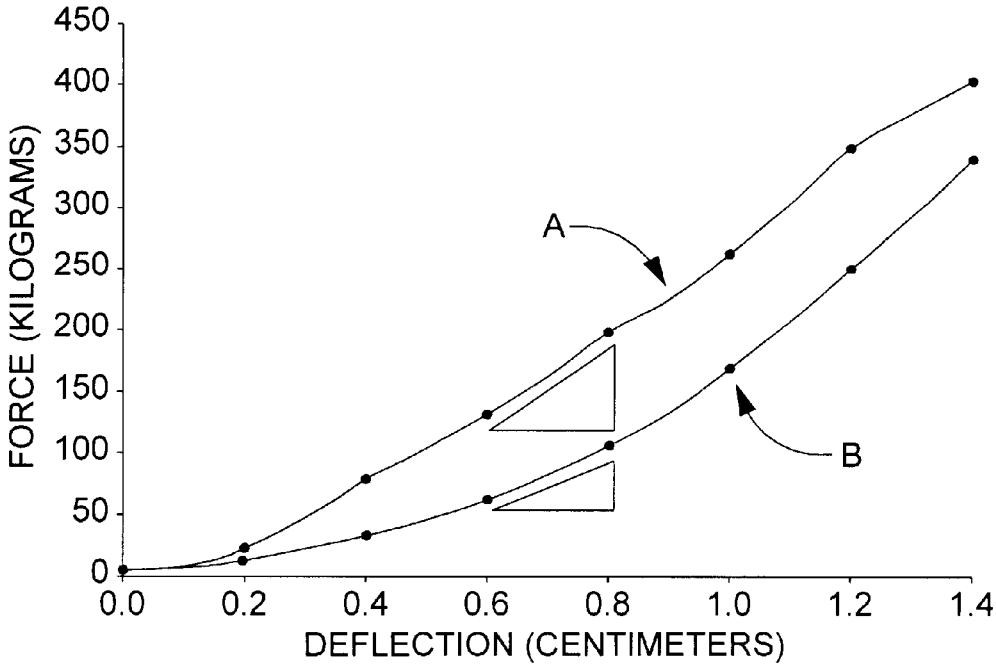
FIG. 4 is a graph showing the difference in deflection of a commercially used container and a container of the present invention.

FIG. 4 shows a graph of bottle A of the present invention versus bottle B which is a present commercial bleach bottle of the same volume. The commercial bleach bottle has a lower projecting ridge with the sidewall being essentially vertical. The bottom surface has a conventional base of a peripheral platform and a centrally disposed recess. There is no outward taper to the sidewall. It is seen from this graph that bottle A requires a greater force (compressive load) to deflect the same amount in centimeters as the commercial bleach bottle. Further the slope of the curve for bottle A is greater than that for bottle B showing that at the lower part of the curves it takes much more force for an equivalent deflection of bottle A.

Figure 5:
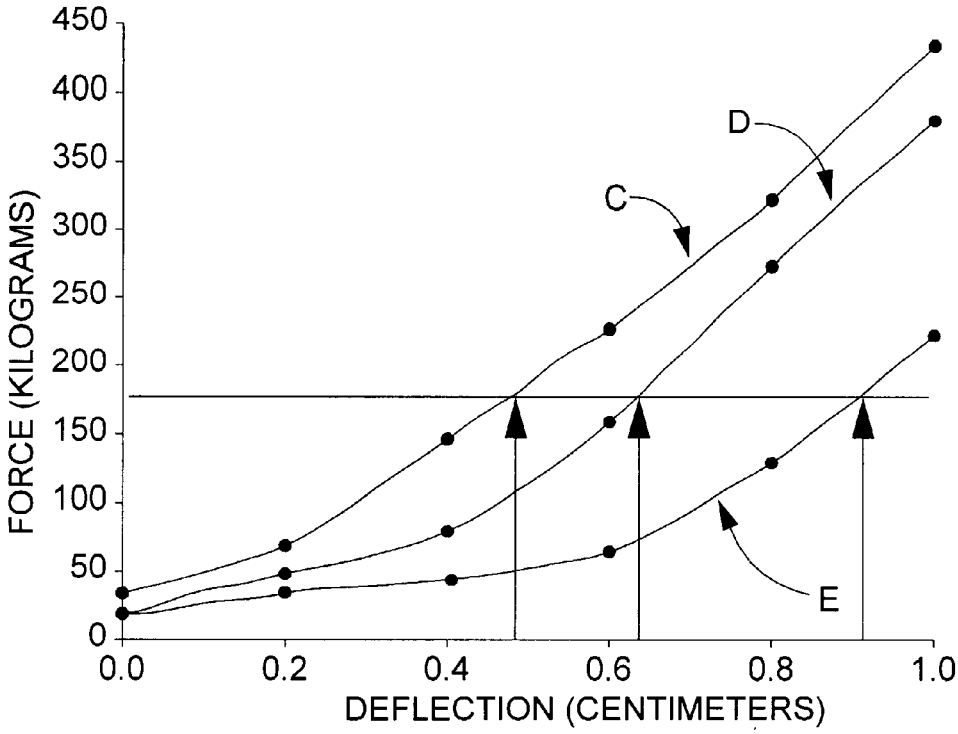
FIG. 5 is a graph showing the difference in deflection of commercially used containers and present containers in cartons and a carton alone.

A benefit of this greater compression load strength is shown in FIG. 5. This graph shows the compression strength of the carton alone (curve E), the commercial bleach bottle in the same carton (curve D) and the bottle of this invention in the same carton (curve C).

It is seen that the carton does provide some of the compressive load strength to the overall bottles and carton package. It also is seen that the present bottle in a carton (curve C) requires a greater force to deflection than the commercial bleach bottle (curve D). The net result is that for the present bottle corrugate can be removed from the carton to reduce the strength of the carton until curve C overlaps curve D. The result is a net savings in carton material while having packaged bottles having a force to deflection equivalent to the present cartoned bottle.

The force to deflection tests on the filled and closed bottles were conducted on an Instron Model No. 4201 with Series IX software. The head piece of the Instron 4201 moves at a rate of 2.54 cm per minute towards the bottle. The tests on the cartoned bottles was conducted on a Lansmont 152-30K. The head piece of the Lansmont 152-30K moves at a rate of 1.27 cm per minute towards the bottle. The tests were conducted under standard conditions of 23.5° C. temperature and 50% relative humidity.

The bottles are made from blow moldable materials. These include polyethylenes, polypropylenes, polyethylene terephthalate and any other blow moldable materials.

What is claimed is:

1. A cylindrical-like container having a continuous sidewall, a base closing a first end of said sidewall and an opening at a second end of said sidewall having an outward taper of about 1° to about 5° from said second end to said first end and, said sidewall devoid of any one of a recess and a projection at a lower part of said sidewall, to thereby increase the compressive strength of said container when said container is substantially filled with a liquid.

2. A cylindrical-like container as in claim 1 wherein the entirety of said sidewall is devoid of any one of a recess and a projection.

3. A cylindrical-like container as in claim 2 wherein said any one of said recess and said projection substantially encircles said sidewall.

4. A cylindrical-like container as in claim 1 wherein said opening is at an upper part of a conical-like section, said conical-like section extending from said second end of said sidewall.

5. A cylindrical-like container as in claim 1 wherein there is a bevel adjacent the first end of said sidewall between said sidewall and said base.

6. A cylindrical-like container as in claim 1 wherein said base is comprised of a plurality of recesses which increase the rigidity of said base.

7. A cylindrical-like container as in claim 1 substantially filled with a liquid, a closure closing said opening.

8. A cylindrical-like container substantially filled with a liquid as in claim 7 where the entirety of said sidewall is devoid of any one of a recess and a projection.

9. A cylindrical-like container substantially filled with a liquid as in claim 7 wherein said any one of said recess and said projection substantially encircles said sidewall.

10. A cylindrical-like container substantially filled with a liquid as in claim 7 wherein said opening is at an upper part of a conical-like section, said conical-like section extending from said second end of said sidewall.

11. A cylindrical-like container substantially filled with a liquid as in claim 7 wherein there is a bevel adjacent the first end of said sidewall between said sidewall and said base.

12. A cylindrical-like container substantially filled with a liquid as in claim 7 wherein said base is comprised of a plurality of recesses which increase the rigidity of said base.

13. An array of containers of claim 7 with the closures at a most upwardly part of said containers, said containers maintained in an array.

14. An array of containers of claim 13 wherein said containers are in a carton.

* * * * *